United States Patent [19]

Robinson

[11] 3,962,730

[45] June 15, 1976

[54] REMOVAL OF FAULTY MATERIAL IN THE MANUFACTURE OF NON-METALLIC WEBS

[75] Inventor: Eric Richard Robinson, Chalfont St. Giles, England

[73] Assignee: Dennison Manufacturing Company, Framingham, Mass.

[22] Filed: Apr. 15, 1975

[21] Appl. No.: 568,342

[30] Foreign Application Priority Data

Apr. 17, 1974 United Kingdom ..... 16767/74

[52] U.S. Cl. ..... 2/243 B; 26/70; 28/77; 33/132 R; 73/159; 83/371; 324/41; 340/259

[51] Int. Cl.[2] ..... B26D 5/00

[58] Field of Search ..... 26/70; 28/77; 2/243 R, 2/243 A, 243 B; 73/159; 340/259; 324/41; 33/132; 242/58.1, 58.2, 58.3, 58.4; 226/9; 83/371

[56] References Cited

UNITED STATES PATENTS

| | | | |
|---|---|---|---|
| 1,012,379 | 12/1911 | Longden | 340/259 |
| 1,827,349 | 10/1931 | Bing | 26/70 X |
| 1,897,731 | 2/1933 | Manegold | 73/159 X |
| 1,899,604 | 2/1933 | Anderson | 340/259 X |
| 2,661,551 | 12/1953 | Anderson | 324/11 R X |
| 3,204,054 | 8/1965 | Ouellette | 340/259 X |
| 3,251,112 | 5/1966 | Ingham, Jr. | 26/70 X |
| 3,612,702 | 10/1971 | Troll | 26/70 X |
| 3,657,727 | 4/1972 | Blevins | 26/70 X |
| 3,856,061 | 12/1974 | Miles | 83/371 X |
| R25,686 | 11/1964 | Sherman | 83/371 X |

*Primary Examiner*—Werner H. Schroeder
*Assistant Examiner*—Conrad L. Berman
*Attorney, Agent, or Firm*—George E. Kersey

[57] ABSTRACT

A process of manufacturing a non-metallic web in which a fault is marked by means of a metal label, layers of the web are stacked on one another, the web is divided into pieces and the individual pieces, still in their stacks, are inspected by means of a metal detector. The invention is of particular value where the web is a textile material and the pieces after inspection are made up into garments.

7 Claims, 5 Drawing Figures

REMOVAL OF FAULTY MATERIAL IN THE MANUFACTURE OF NON-METALLIC WEBS

BACKGROUND OF THE INVENTION

This invention relates to the use of labels in processes of manufacture employing non-metallic material in web form, for example woven and knitted fabrics, plastics sheet material and special papers.

It has hitherto been the practice for textile material to be inspected at the mill by visual inspection of the web, as it passes an inspector. Where the inspector sees a fault in the web, he or she marks the fault by inserting a string in the selvedge. The web is then wound into a bale and the bale is shipped to the user who claims an allowance depending on the number of strings. The textile material is then made up into garments and those garments incorporating faults have to be rejected or treated as seconds. This means that a considerable amount of effort is put into the manufacture of garments incorporating faults but it has hitherto been found cheaper to follow this course than to extract those parts of the web containing faults.

SUMMARY OF THE INVENTION

According to the present invention, a process of manufacture comprises providing a non-metallic web, inspecting the web visually for at least one occasionally occurring characteristic, when such characteristic is noticed, marking its location by adhesively attaching to the web, adjacent the characteristic, a label incorporating a metal foil, dividing the web into pieces, and inspecting the pieces by a metal detector to locate the label.

The invention is particularly suitable where the parts into which the web is divided are stacked so that any labels on the parts constituting the lower layers of the stack are not visible. The occasionally occurring characteristic will, in most cases, be a fault or area of low standard but could of course be an area having a particularly desirable property or merely a property which is neither better nor worse than that of the majority of the web but one which has to be separated out for some particular reason. The characteristic will usually be one which has at least apparently random occurrence.

The invention is particularly applicable to the textile trade. Thus, during the usual visual inspection of woven or knitted fabric at the mill, any faults will be marked, not by strings in the selvedge as is usual at present, but by labels incorporating metal foil. Such labels can be applied to the actual location of the fault at any point across the width of the fabric instead of only at the edge as is the case with strings. In the case of a fault of substantial extent in either direction, for example, a faulty weft extending right across the cloth, the fault may be labeled at more than one point.

The user of the fabric, for example, a garment manufacturer, may then use the fabric in the normal way but ignoring, for the time being, the possible existence of faults. Thus the fabric may be laid up, that is to say, formed into a stack of, say 150 layers, a pattern applied, and the stack divided into sub-stacks by cutting out. Each sub-stack is then examined by means of a metal detector, for example, one operating by electromagnetic wave reflection or on the induction principle. Any sub-stack found to contain a label and therefore a fault is fractionated and each fraction, for example each half, examined by the metal detector. The half indicated as containing a label is again halved and examined and so by successive halving and, when the numbers are reduced to say ten, by visual inspection of the individual pieces the label is finally located. A decision can then be made as to whether or not the faulty piece requires to be scrapped.

Preferably, the attached label carries indicia on its surface remote from the web. In the case of the textile process described, the indicia may indicate the batch number of the cloth so that a scrapped piece can be replaced by another piece from the same batch. It will be appreciated that the indicia may incorporate any required information such as dye batch, loom number, the inspector's identity and the date of inspection. Preferably, the indicia are applied to the label substantially simultaneously with the attaching of the label to the web.

The invention may be applied to other processes where it is preferable not to deal with a detected fault in a web at an early stage in the process but to proceed as if the web was faultless and deal with the fault after the web has been divided into parts. One example is paper and paper board conversion where faulty objects produced from the web can be removed. A further example is plastics where a web is embossed and subdivided into, for example, wall tiles. Other example include plastics foam sheet, polyvinyl chloride sheet, and wallpaper.

Preferably, the label is self-adhesive. A suitable label is disclosed in my application Ser. No., 568,241 entitled Labels and filed simultaneously herewith. The label is preferably applied by a handheld labeling device such as those used in shops for labeling goods with prices. Such devices employ labels carried by a rolled backing strip having a release coating and transfer one label at a time from the backing strip to the object to be labeled, at the same time printing indicia on the label. Usually the indicia are printed by means of embossed characters on endless belts so that the indicia can be altered as required. The preferred form of labeling device for the purposes of the present invention is one in which the label is moved bodily in a direction generally perpendicular to its plane into contact with the object to be labeled by contrast with the more usual stroking action. In one particularly preferred device, the label is projected by a soft rubber cup having a rim whose shape corresponds to that of the label and which strikes the non-adhesive side of the label almost at the instant the label becomes completely separated from the backing strip.

The invention may be carried into practice in various ways but one strip of labels embodying the invention and a process in which the labels are used will now be described by way of example with reference to the accompanying drawings.

BRIEF DESCRIPTION OF THE SEVERAL VIEWS OF DRAWINGS

DETAILED DESCRIPTION

Figure 1:
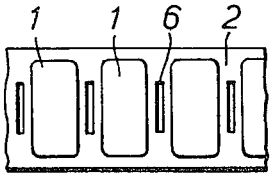
FIG. 1 is a plan view of a short section of the strip of labels.

The strip shown in FIG. 1 comprises a series of rectangular blank labels 1 mounted on a strip 2. Each label is rectangular with rounded corners and comprises a layer of aluminum foil 3 which is attached to a facing layer 4 of paper by means of an adhesive, not shown in the drawings. The aluminum foil carries on the side remote from the paper 4 a layer 5 of pressure-sensitive adhesive by which the label is attached to the strip 2; this strip is of thin kraft paper impregnated with a release agent so that the labels may be separated from the strip without detaching the adhesive 5 from the aluminum foil 3. Between adjacent labels there are rectangular apertures 6 to provide indexing means for feeding the strip through a labeling machine.

Figure 2:
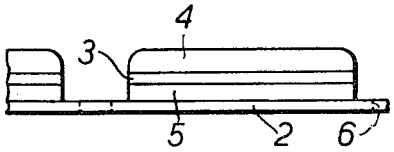
FIG. 2 is a side elevation to an enlarged longitudinal scale of part of the strip shown in FIG. 1, the vertical scale being exaggerated.
Figure 3:
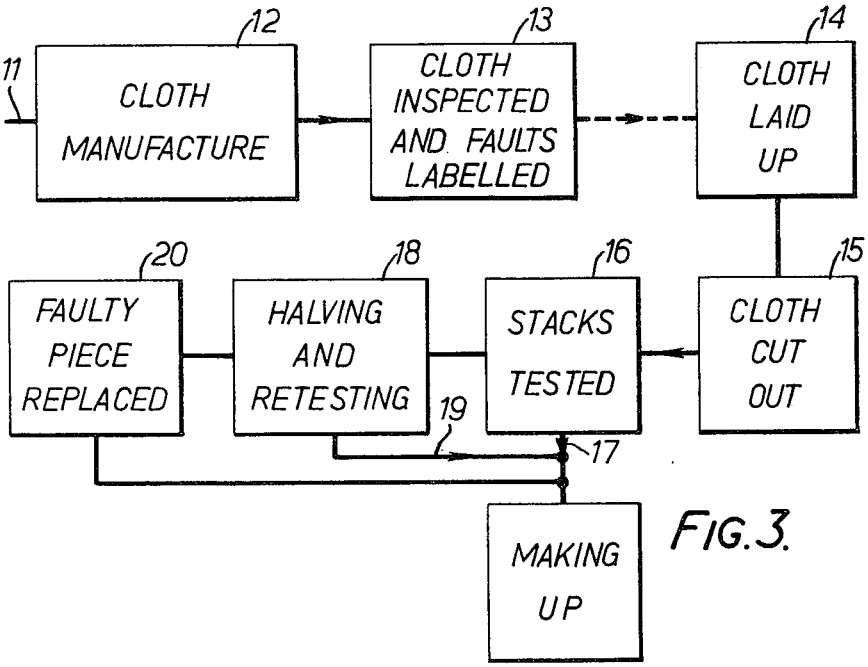
FIG. 3 is a flow diagram showing a process in which the labels may be used.

The labels shown in FIGS. 1 and 2 can be used in various processes in which webs of material have to be marked at certain points and the marked points have to be located after the web has been separated into a number of parts. The process illustrated in the flow diagram of FIG. 3 is the production of garments from fabric.

Yarn is supplied at 11 to the cloth manufacturer 12 who produces cloth, for example by weaving or knitting, the cloth being in the form of a continuous web. At some stage before the cloth is despatched from the cloth manufacturer, its whole length is visually examined at 13 and any fault which is detected is marked by means of a label from the strip shown in FIGS. 1 and 2. Prior to being applied to the cloth, the label is marked with any required indicia. Thus, for example, the label may carry information relating to one or more of the following items: the batch number of the cloth, the batch number of the dye or other treatment medium applied to the cloth, the number of the machine on which the cloth was manufactured or treated, the number of the inspector, and the date. Although the label may be applied by hand, it is preferably applied by means of a manually operated labeler of the kind commonly used to apply price labels to goods in supermarkets and other retail outlets. One particularly suitable labeler is marketed by the Assignee of this invention under the name "One Touch Labeler" and is shown in FIGS. 4 and 5 and is described in detail below.

The cloth with the faults labeled is then wound into a roll and this is delivered to the garment manufacturer.

The garment manufacturer then lays up the cloth 14 so that, say, 200 layers are superimposed. A pattern is then placed on the topmost layer and the cloth is then cut out 15 using a band saw. This produces a number of stacks, each being of 200 identical parts. Each stack is then tested for the presence of a label and hence of a fault by means of an induction type metal detecting device 16. If no label is detected, the stack is passed on for making up 17. If the detecting device gives a positive result for any stack, the stack is halved and each half is tested 18. If either half is found to contain no label, it is passed on for making up 19, while a half found to contain a label is again halved and testing is repeated. Halving and retesting is continued until the number of pieces remaining is small enough to make visual inspection easy. When the piece or pieces carrying labels are located, the remaining pieces are passed on for making up and the labeled pieces are examined. It may be found that the fault is of no consequence, for example, it may be at a point which will be invisible in the made up garment. If the piece cannot be used, the faulty piece is replaced 20 by cutting an identical piece from a spare length of cloth kept for the purpose. By means of the information carried by the label, it is possible to match the rejected piece with a spare length from the same roll of cloth or the same batch of rolls or as appropriate.

Figure 4:
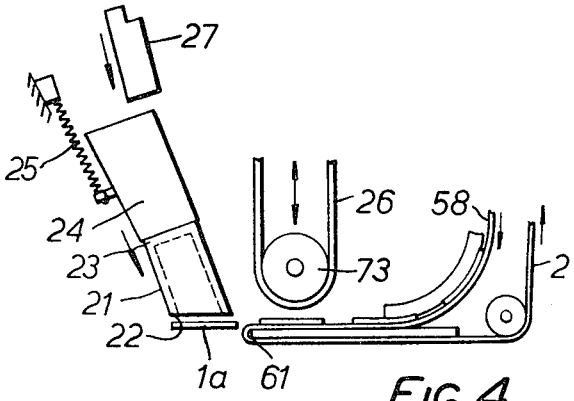
FIG. 4 is a fragmentary diagrammatic view of the label-dispensing part of a labeler using the labels shown in FIGS. 1 and 2.
Figure 5:
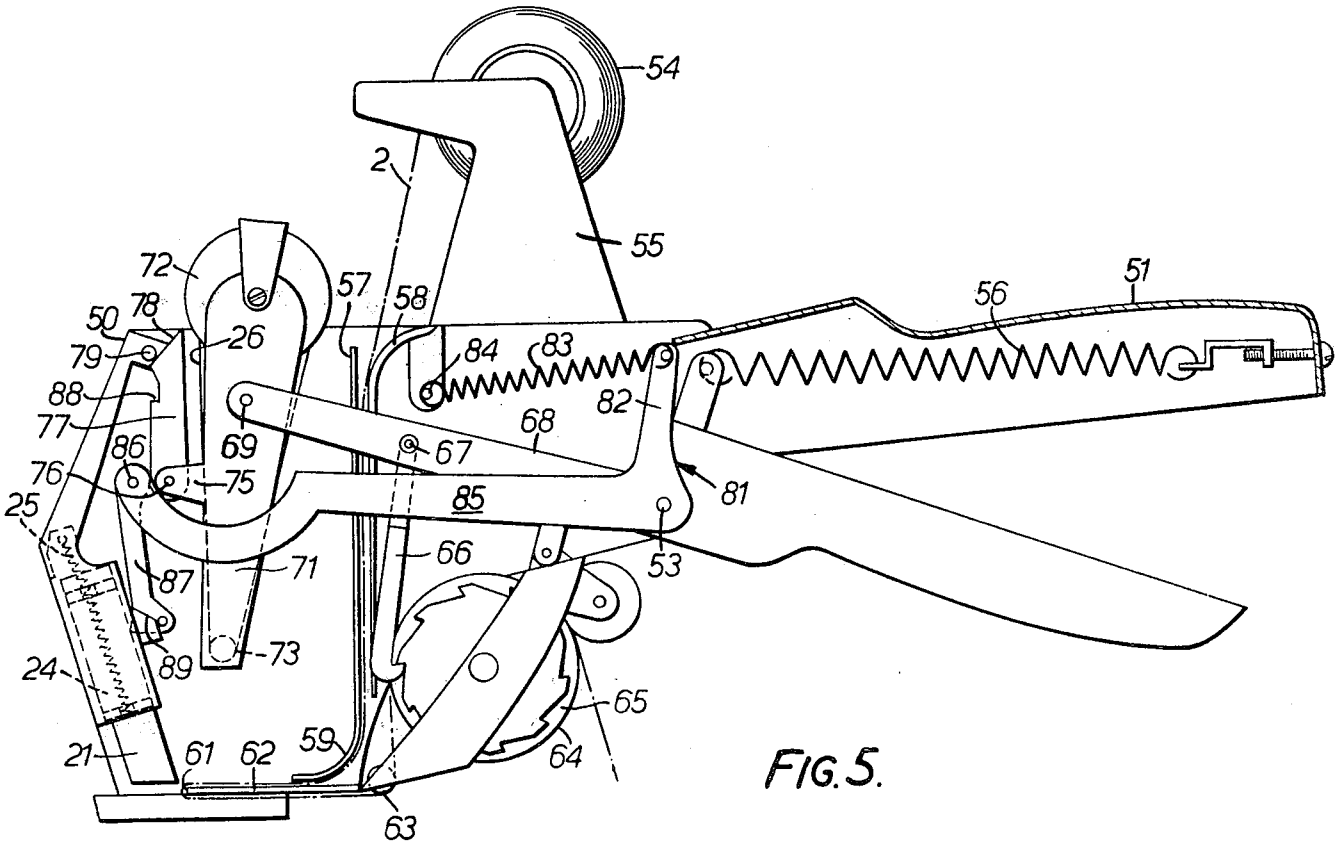
FIG. 5 is a diagrammatic view of the complete labeler.

The labeler shown in FIGS. 4 and 5 comprises a boxlike body 50 having two parallel walls lying in planes parallel to the plane of the drawing and between which the working parts of the labeler move. From the rear of the body 50 there extends a fixed handle 51 and a movable handle 52, the movable handle being pivoted on the body by a pivot 53. The movable handle and the parts attached to it are biased to the positions shown by a tension spring 56. A roll 54 comprising a strip of labels of the construction described in relation to FIGS. 1 and 2 is mounted between lugs 55 projecting from the body 50 and the label strip 2 extends therefrom between a pair of guides 57, 58 within the body 50 around a curved portion 59 at the bottom of the guide 57 and then turns through 180° around a sharp edge 61 at the forward edge of a plate 62. The label strip then passes around a roller 63 on to a feed roller 64 having teeth (not shown) which engage in apertures in the label strip 2. The feed roller 64 has ratchet teeth 65 which are engaged by a pawl 66 which is pivoted by a pin 67 on one of a pair of identical arms 68 which are integral with the movable handle 52 and project forward of the pivot 53. The pin 67 is surrounded by a torsion spring which biases the pawl 66 into engagement with the teeth 65. The forward ends of the arms 68 carry a pin 69 by which they are pivoted to a pair of identical bars 71 carrying between them rollers 72 and 73 at the upper and lower ends respectively and around which run a plurality of endless rubber printing belts 26. The bars 71 are carried in guides (not shown) in the body 50 for reciprocation of the lower roller 73 towards and away from the part of the label strip 2 overlying the plate 62.

Projecting forwardly from the bars 71 are lugs 75 on which are pivoted the lower ends of a pair of triggers 77 which are biased about their pivot 76 by torsion springs (not shown) in the anticlockwise direction as viewed in FIG. 5 so that camming surfaces 78 at their upper ends run on a transverse bar 79.

A pair of bell crank levers 81 are pivoted on the pivot 53 and each has one short arm 82 connected to one end of a tension spring 83 the other end of which is anchored at 84 to the body 50, and has a long arm 85. The free ends of the arms 85 carry a transverse pin 86 on which is pivoted an arm 87 which is biased, by a torsion spring around the pin 86, in an anticlockwise direction, the movement in this direction being limited by a stop carried by the arms 85 and not shown in the drawings.

A plunger 24 is mounted in guides in the body 50 for reciprocation along its longitudinal axis and is biased to an upper position as shown by a tension spring 25. At the lower end of the plunger there is a soft rubber cup 21 having a rectangular rim 22, shown in FIG. 4, of the same dimensions as the label 1.

Operation of the labeler is as follows. The belts 26 are adjusted so that the appropriate type is adjacent the plate 62 and the part of the labeler adjacent the cup 21 is positioned on the surface to be labeled. The handle 52 is then squeezed towards the handle 51. This causes the bars 71 to be moved down and the type belts 26 are moved into contact with a label lying on the plate 62 so that indicia are printed on the exposed ink-receiving surface of the paper layer 4 of the label. The pawl 66 moves down and past a tooth 65 on the feed wheel 64. As the bars 71 move down the lugs 75 lower the pin 76 which draws down the triggers 77 until hooks 88 thereon engage under the pin 86. On subsequent release of the movable handle 52, the movable handle returns to the position shown under the influence of the spring 56 thus causing the pawl 66 to move upwards and rotate the feed wheel 64 sufficiently to move the part of the backing strip carrying the now printed label 1 around the sharp edge 61 whereupon the label, which cannot follow the sharp change of direction of the backing strip, separates from the backing strip 2 and comes into position immediately below the rim 22 of the cup 21 as shown in FIG. 4. As the triggers 77 move upwards they carry the pin 86 and the arm 87 with them thus stressing the spring 83. Towards the end of the stroke, the camming surfaces 78 engage the bar 79 thus causing the triggers 77 to turn clockwise about the pivot 76 so that the hooks 88 become disengaged from the pin 86. The bell crank levers 81 therefore rotate rapidly in an anticlockwise direction about the pivot 53 under the influence of the spring 83 and the arm 87 is driven sharply downwardly. Its lower end engages the upper end of the plunger 24 which is driven downwards smartly towards the label immediately below the cup and the label is propelled bodily and in a direction generally perpendicular to its plane against the adjacent surface of the material to be labeled. As the arm 87 continues to move downwards taking the plunger 24 with it, the lower end of the arm 87 engages fixed cams 89 so that the arm is caused to move anticlockwise about the pin 86 and become disengaged from the plunger 24 which is then retracted by the spring 25. The condition of the labeler is thus returned to the original condition and it is ready for a repeat operation.

What I claim as my invention and desire to secure by Letters Patent is:

1. A process of manufacture which comprises providing a non-metallic web, inspecting said web visually for at least one occasionally occurring characteristic, when such characteristic is noticed marking its location by adhesively attaching a label incorporating a metal foil to said web adjacent the characteristic, dividing said web into pieces, and inspecting said pieces by a metal detector to locate said label.

2. A process according to claim 1 wherein, subsequent to marking and prior to said division, different portions of said web are superimposed on one another to form a stack, and said stack is divided into a plurality of sub-stacks each containing a plurality of identical pieces.

3. A process according to claim 1 wherein said web is a textile fabric.

4. A process of garment manufacture which comprises:

providing a web of textile fabric, inspecting said fabric visually for at least one occasionally occurring characteristic, when such characteristic is noticed marking its location by adhesively attaching to said web adjacent said characteristic a label incorporating a metal foil, superimposing portions of said web to form a stack, dividing said stack into a plurality of sub-stacks each containing a plurality of identical pieces, scanning each said sub-stack by means of a metal detector, fractionating any of said sub-stacks found to contain a label and examining each fraction by said metal detector, eliminating any of said pieces detected to contain a label, and making up the remaining said pieces into garments.

5. A process according to claim 4 wherein the fractionating step is a halving step and any half containing a label is again halved and examined, each resulting half being successively halved and the pieces finally being inspected visually individually.

6. A process according to claim 4 including replacing a rejected piece by substituting a perfect piece.

7. A process according to claim 4 wherein including printing indicia on the opposite surface of said label, substantially simultaneously with the attaching of the label to the web by one of the surfaces of said label.

* * * * *